US007189192B2

(12) United States Patent
Edgeton

(10) Patent No.: US 7,189,192 B2
(45) Date of Patent: Mar. 13, 2007

(54) THERAPEUTIC EXERCISING APPARATUS AND THE METHOD FOR THE NECK

(76) Inventor: Calvin Edgeton, 1424 Pearl, Apt. 205 CE, Denver, CO (US) 80203

( * ) Notice: Subject to any disclaimer, the term of this patent is extended or adjusted under 35 U.S.C. 154(b) by 320 days.

(21) Appl. No.: 10/247,233

(22) Filed: Sep. 19, 2002

(65) Prior Publication Data

US 2004/0058780 A1 Mar. 25, 2004

(51) Int. Cl.
*A63B 23/025* (2006.01)
*A63B 21/02* (2006.01)

(52) U.S. Cl. ..... 482/10; 482/124

(58) Field of Classification Search ..... 482/10–11, 482/93, 99, 105, 124; 602/32–36
See application file for complete search history.

(56) References Cited

U.S. PATENT DOCUMENTS

| | | | | |
|---|---|---|---|---|
| 1,530,748 | A * | 3/1925 | Alastalo | 482/10 |
| 2,051,366 | A * | 8/1936 | Catron | 482/10 |
| 3,542,364 | A * | 11/1970 | Gaumond | 482/88 |
| 4,168,060 | A * | 9/1979 | Hohenfeldt | 482/10 |
| 4,468,023 | A * | 8/1984 | Solloway | 482/10 |
| 4,645,198 | A * | 2/1987 | Levenston | 482/10 |
| 5,505,677 | A * | 4/1996 | Hinds | 482/10 |
| 6,106,437 | A * | 8/2000 | Brooks | 482/10 |

OTHER PUBLICATIONS

"Everlast Leather Head Harness Website Materials" obtained from www.fit-senior.com, Provided by Watkins Fitness & Sports Equipment, 226-228 S. Main Street. Salisburv. North Carolina 28144.
"Cybex Multi-Neck Website Materials" obtained from www.physica.com Provided by Physica & Co., Inc., 1265 Birchrun Rd., Chester Springs, PA 19425.
"Cybex Multi-Neck Website Materials" obtained from www.ecybex.com Provided by Cybex International, Inc., 10 Trotter Drive, Medway, MA 02053.

* cited by examiner

*Primary Examiner*—Jerome Donnelly
*Assistant Examiner*—Fenn C. Mathew
(74) *Attorney, Agent, or Firm*—Simmons Perrine PLC

(57) ABSTRACT

Apparatus for exercising the neck includes a head assembly connected to an anchor assembly by a flexible tether that has a resilient elastic portion. The head assembly includes a cap portion, an adjustable harness to secure the cap portion on the head and a saddle piece that extends across the back of the neck along the atlanto occipital joint when mounted. The cap portion can be a rigid helmet that forms a cam surface with a channel for slideably receiving the tether and may include a frontal extension forming a continuation of the cam surface. The tether is secured to the posterior of the helmet so as to extend over the cam surface to the anterior portion. The method includes engaging the atlanto occipital joint region with a saddle coupled to a source of variable force and extending the head and neck into an extension orientation against the force.

4 Claims, 4 Drawing Sheets

THERAPEUTIC EXERCISING APPARATUS AND THE METHOD FOR THE NECK

FIELD OF THE INVENTION

The present invention is generally directed to exercising and the therapeutic apparatus and methods for the human body. The invention is particularly directed to an apparatus and a method for exercising the human neck and related muscles. The invention specifically concerns an apparatus and method for providing variable resistance in exercising the neck while providing muscular stabilization and lateral balancing during the exercising event.

BACKGROUND OF THE INVENTION

The cervical spine and muscular of the neck of the human body is extremely complex such that the movement of the head with respect to the body requires an integrated movement of many muscles in coordination with the articulation of the cervical spine. As such, many people suffer from conditions resulting from improper orientation of the cervical spine, imbalance and strength of the posterior cervical muscles and compression of the spine. These conditions may result from faulty or sustained postures, trauma, emotional stress and the like.

Indeed, many people exhibit a variety of discomforts caused by the misalignment of the cervical spine and imbalance of the associated muscles. For example, localized pain, headaches, decreased circulation and soreness, to name a few, decrease the quality of life of persons suffering from these conditions. These conditions have an associated cycle of pain and muscle contraction that lead to decreased function and the potential soft tissue dysfunction.

The need for exercising the neck, both for therapeutic and strengthening purposes, has long been recognized, and devices are known in prior art for addressing one or both of these issues. Some such prior art devices simply involve engaging the head with some support structure and mounting weights thereon. For example, in U.S. Pat. No. 5,162,027, issued Nov. 10, 1992 to Robinson, a helmet in the form of an annular ring is mounted to the head by a harness, and a plurality of weights may be placed in and around the annular band in order to exercise the neck. In U.S. Pat. No. 4,339,124 issued Jul. 13, 1982 to Vover, a helmet is provided with a vertically upward projecting post upon which barbell type weights may be selectively placed so as to apply a heavier load that must be supported by the neck muscles. Each of these devices, however, can increase compression of the cervical spine and, indeed, may cause compression of the neural arches when the head and neck are extended. This is especially true for the device shown in U.S. Pat. No. 4,339,124.

Other approaches in the prior art recognize that the complex nature of the cervical spine and muscles require proper resistance in more appropriate directions and proportions. In U.S. Pat. No. 4,645,198 issued Feb. 24, 1987 to Levenston, a neck exercising device is disclosed that includes and upright frame with handles to stabilize the body of the user. The user then wears a helmet provided with attachment hooks. These cords extend downwardly through the frame and are attached to weights that supply the load during the neck-exercising event.

This device still can permit compression of the spine. A somewhat similar structure is disclosed in U.S. Pat. No. 6,106,437 issued Aug. 22, 2000 to Brooks. Here, however, a person is in a seated position and an annular frame is oriented in a horizontal frame at approximately the height of the head. The annular frame carries a plurality of pulleys which are selectively positionable about its circumference. The user wears a helmet that is provided with hooks to which cords are attached. These cords extend through the pulleys and are connected to weights to provide the exercising load on the neck. By allowing the pulleys to be selectively positionable about the annular frame, more versatility is accomplished. This device also reduces compression on the spine since the tension forces on cords are in a direction radially outwardly from the head.

While each of the devices described above may have varying degrees of benefits in exercising or strengthening the neck, they still fail to address all of the complexities that are involved in the mechanics of the upper back, neck and head of the human body. These devices fail to take into account the occipital and parietal weight of the head during vertical cervical extension. Also, the head is subject to variable rotational ability between a state of flexion and a 45-degree extension. Accordingly, there is a need for improved neck exercising apparatus and methods which are safe to be implemented in both supervised and unsupervised exercising activities. The present invention is directed to meeting this need.

SUMMARY OF THE INVENTION

It is an object of the present invention to provide a new and useful apparatus and method for exercising the human neck.

It is another object of the present invention to provide an apparatus and method for the safe and isolated unilateral resisted extension of the posterior cervical muscles of the neck without causing abnormal or extension compression to the cervical spine.

It is a further object of the present invention to reduce tension in the muscles of posterior cervical spine thereby to reduce the muscle soreness or associated referenced pain from irritation of the suboccipital nerves.

It is still a further object of the present invention to provide a method and apparatus for strengthening the neck muscles in an integrated manner to promote a more symmetrical posterior realignment of the head and upper cervical vertebrae.

Yet another object of the present invention is to retard the degenerative changes of the vertebrae discs, articular facets and soft tissue.

Still a further object of the present invention is to provide apparatus and method for increasing circulation in the neck muscles.

Yet a still further object of the present invention is to provide a neck exercising apparatus that is simple in construction and relatively inexpensive in manufacture.

A still further object of the present invention is to provide a method and apparatus that provides variable resistance loads through motion of the head from a natural position at 0° to a state of extension so as to adjust for the occipital and parietal weight of the head during the vertical cervical extension.

To accomplish these objects, then, the present invention is directed to an apparatus adapted to mount onto the head and neck of a person in order to exercise the neck. Broadly, this apparatus includes a head assembly constructed as a cap portion adapted to be worn on the head and a harness operative to secure the cap portion on the head in a mounted state and a saddle piece that extends across the back portion of the neck when in the mounted state. A flexible tether interconnects the cap portion and an anchor assembly with the flexible tether including an elastic portion.

In another form of the invention, the present invention provides a head assembly in the form of a helmet having an upper surface configured as an articulating cam having a posterior portion formed at a smaller radius of curvature then the occipital portion. A flexible tether is secured posteriorly of the helmet and extends across the articulating cam surface of the helmet in the sagittal plane when worn. This flexible tether is either self-constructed to provide a variable resistance during use or, alternatively, is connectable to a device that provides a variable resistance.

In any event, it is preferred that the cap portion of the present invention be constructed as a rigid helmet having an interior cavity adapted to receive the head of the person. This helmet has an upper cam surface extending from the rear portion of the helmet to a front portion of the helmet with the tether having a first end secured to the rear portion of the helmet when in the assembled state with a first end portion of the tether extending across the helmet cam surface. The helmet cam surface has a guide channel structure associated therewith and, for example, formed therein. The first end portion of the tether is disposed in the guide channel for slideable movement therein. The helmet also includes a frontal extension projecting forwardly of the person's forehead when the helmet is in the mounted state. The frontal extension has an upper surface formed as a continuation of the helmet cam surface. Here, the first end portion of the tether extends across the upper surface of the frontal extension. This frontal extension terminates in a range of approximately two inches to six inches forwardly of the frontal region of the head when in the mounted state.

The interior of the helmet is provided with appropriate cushioning pieces that may be adjustable, such as air bladders, or are otherwise conformable to the shape of the human head. The harness includes left and right rear straps each having an upper end secured to the helmet and a lower end opposite the upper end. The rear straps may be a single integral strap. The connection of the upper ends is such that the location thereof can move reciprocally in the sagittal plane. The saddle piece is then mounted between and supported by the left and right rear straps and is positioned so as to extend along side the atlanto occipital joint region of the neck just below the external protrubence when in the mounted state. To this end, the saddle piece is formed of a stiff yet flexible material, such as plastic.

The harness can also include left and right front straps each having upper ends secured to the cap portion and the lower ends opposite the respective upper end. The lower end of the left front strap secured to the lower end of the left rear strap at a first location and the lower end of the right front strap is secured to the lower end of the right rear strap at a second location. A chin strap then extends between the first and second locations with these locations selected to be approximate to the temporo mandibular joint and carries a chin support piece. This harness is adjustable in size so as to accommodate different sizes and shapes of the human head.

Where an anchor assembly is provided in the apparatus of the present invention, it is formed, for example, as an elongated rigid bar. A pair of foot stirrups are provided so that a user may engage the bar with his/her feet in either a standing or sitting position.

The tether may be formed as an elastic cord, such as a rubber tube, or, alternatively, may have an inelastic portion with a variable resistance provided by a spring element. Alternatively, the tether may be entirely inelastic in which case it is connectable to a source of variable resistance. In any event, the tether may be selectively adjustable in length.

The method according to the present invention includes in all of the steps that are inherent in the above-described structures.

The present invention also contemplates a method of exercising the head and neck of a person. This method may include any of the steps that are accomplished by the structure described with respect to the apparatus described in this disclosure as well as the actions accomplished by such structure. Broadly, the method of the present invention includes the step of engaging the atlanto occipital joint region of the neck with a saddle piece. A source of variable force is provided, and the saddle piece is coupled to this source of variable force. The method then includes the step of rotating the head and neck into an orientation corresponding to extension thereof in such manner that are varying upward force is applied to the saddle and thereby to the allanto occipital joint.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention is directed to a neck exercising apparatus that may be used for therapeutic and strength building exercises. It should be understood that this invention is constructed to allow articulation of the head and neck from a natural 0° state to extension in a safe manner without causing abnormal or extensive compression to the spine. This invention both provides variable resistance as the head is articulated in the sagittal plane and utelateral resisted extension of the posterior cervical muscles with specific isolation of the sub occipitals during the exercise. Broadly, the invention includes a head assembly that is adapted to mount onto the head and neck of a person and a means for providing variable resistance to the muscles during articulation.

Figure 1:
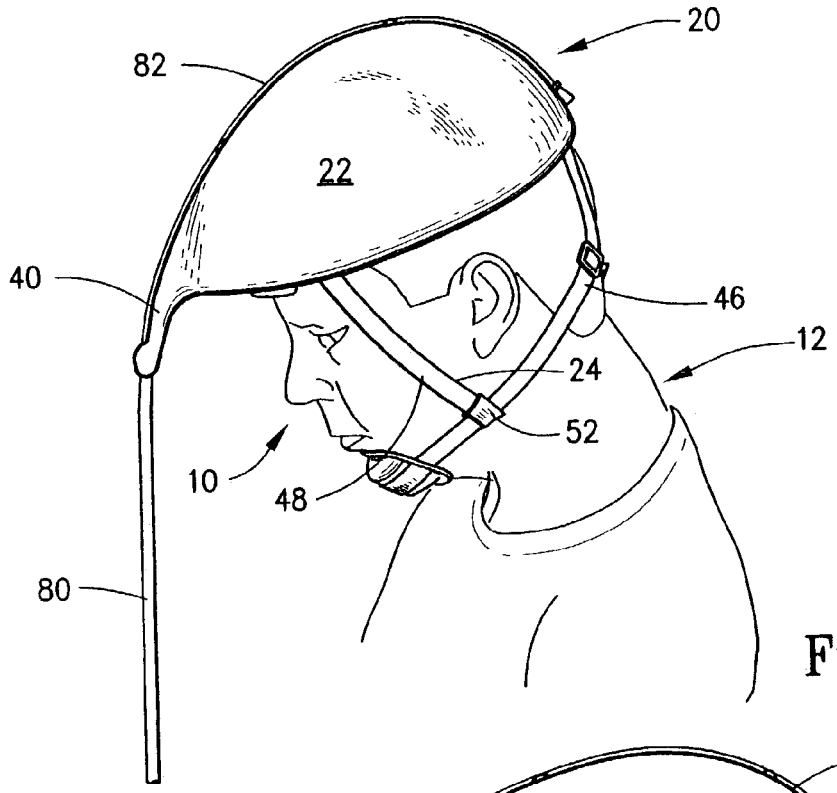
FIG. 1 is a perspective view of a person wearing the head assembly of the neck exercising apparatus according to a first exemplary embodiment of the present invention with the head and neck shown in a state of flexion.
Figure 2:
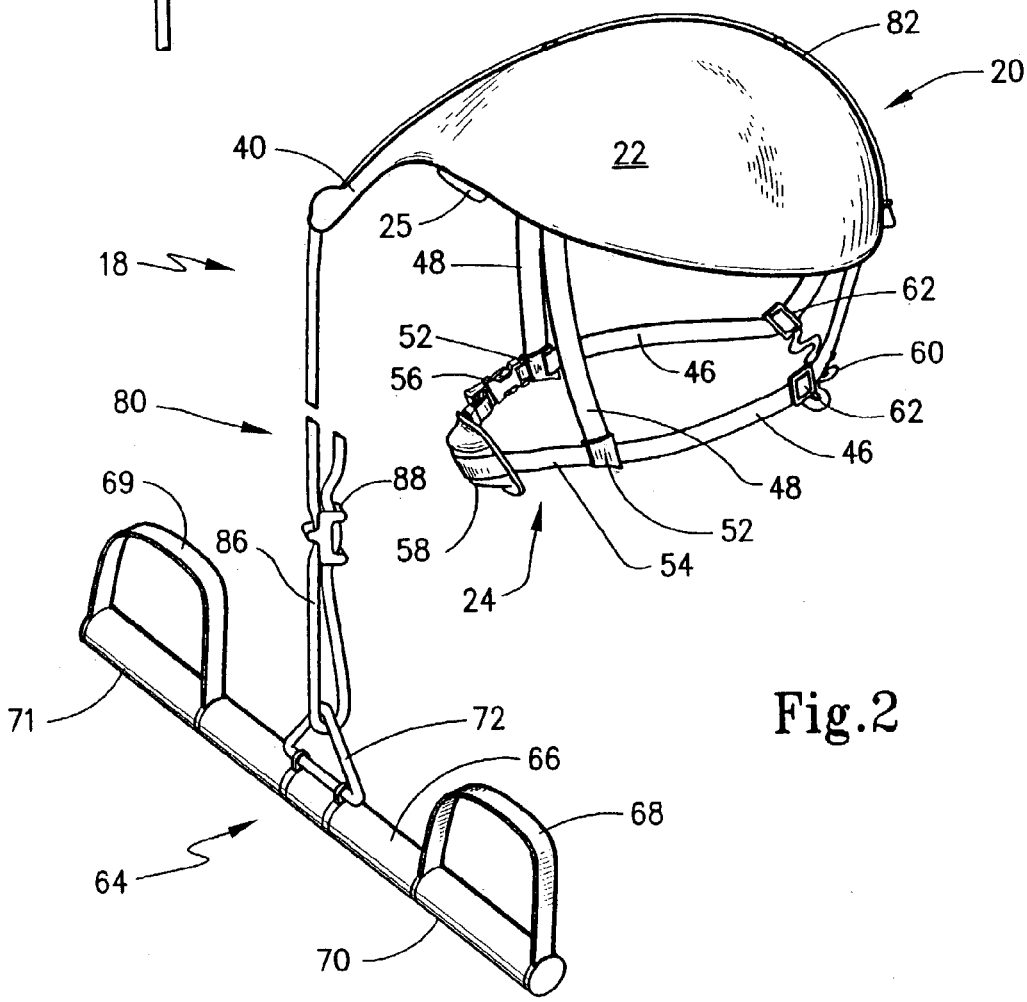
FIG. 2 is a perspective view of the neck exercising apparatus according to the first exemplary embodiment of the present invention.

With reference first to FIG. 1, it may be seen that the head assembly 20 is mounted onto the head 10 and neck 12 of a person in order to exercise neck 12. Head assembly 20 includes a cap portion which may be a helmet 22 that is secured to head 10 by means of a harness 24. Head assembly 20 supports a tether 80 as more thoroughly described below. With reference to FIG. 2, it may be seen that the exercise apparatus 18 of the first exemplary embodiment of the present invention includes the head assembly 20, an anchor assembly 64 and the tether 80 that interconnects head assembly 20 and anchor 64.

Figure 3:
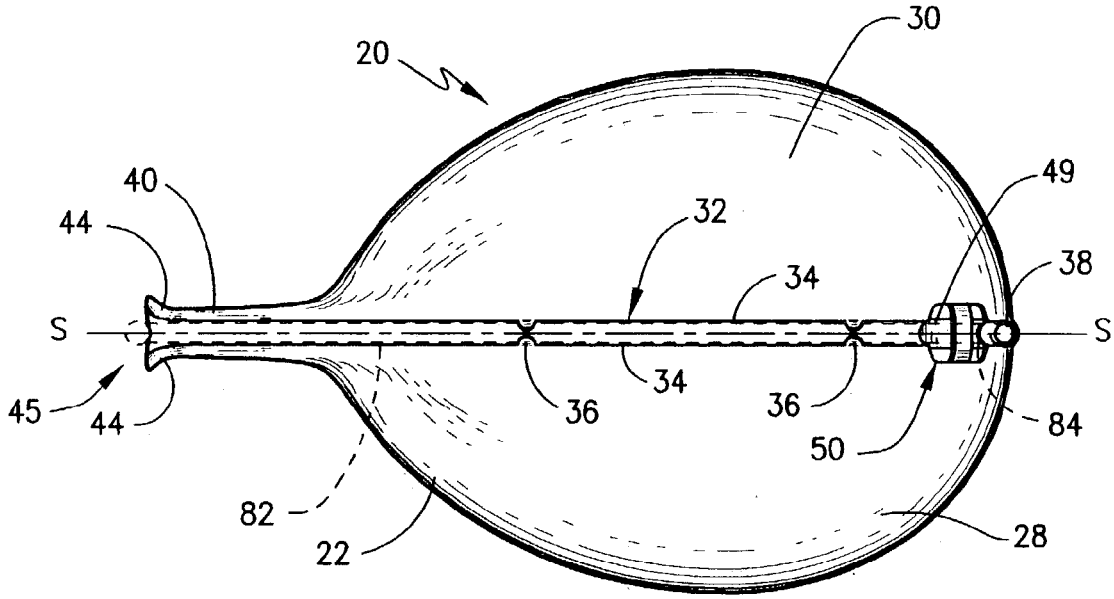
FIG. 3 is a top plan view of the head assembly of FIGS. 1 and 2.
Figure 4:
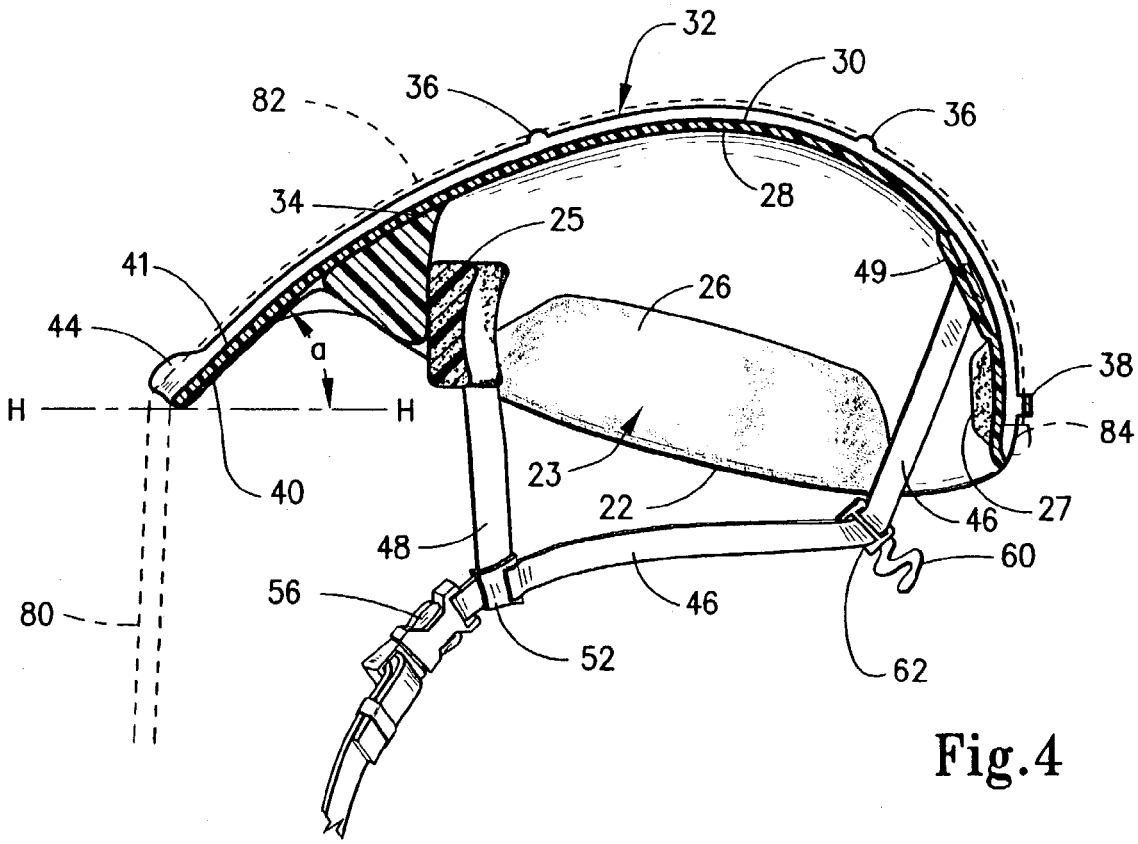
FIG. 4 is a side view in cross-section showing the head assembly of FIGS. 1, 2 and 3.

The structure of head assembly 20 is best illustrated in FIGS. 2–4. In these figures, it may be seen that head assembly 20 includes helmet 22 that is formed of a rigid material such as high impact plastic, high density molded styrofoam or any other suitable material. Helmet 22 has an interior cavity 23 that is sized and adapted to receive the head of a human wearer. To this end, suitable cushions 25, 26 and 27 are located in the interior 23 to provide a firm solid fit of helmet 22 onto the head of the wearer. These cushions may be formed of any convenient material, such as a conforming sponge, close-celled foam or the like. Alternatively, these cushions could be air filled bladders or any other equivalent cushion as is known in the art.

In any event, helmet 20 has an upper shell 28 that has an upper helmet surface 30 that is formed as an articulating cam in sagittal plane "S" (FIG. 3). This cam surface extends from a rear portion of helmet 22 to a front portion of the helmet. A guide channel structure 32 extends centrally of helmet 22 so that it resides in the sagittal plane "S" when the helmet is in a mounted state on the head of the wearer. Channel structure 32 is formed by a pair of spaced apart, substantially parallel ribs 34 that are bridged, for example, by a pair of eyelets 36. Channel structure 32 is sized and adapted to slidably receive a first end portion 82 of tether 80. To this end, first end 84 is secured at the rear portion of helmet 22 by a releasable clamp 38. Guide channel structure 32 would be a separate piece that is secured to helmet in any convenient manner, but integrally molded with shell 28.

Helmet 22 also includes frontal extension piece 40 that projects forwardly of the person's frontal region or forehead about two inches to six inches when helmet 22 is in the mounted state. Frontal extension 40 has an upper surface 44 formed as a continuation of the helmet cam surface such that the first end portion 82 of tether 80 extends across the upper surface of the frontal extension when the helmet and tether are assembled together. As may be seen in FIG. 4, frontal extension 40 is formed at an acute angle "a" with respect to horizontal plane "H" with this angle being in a range of about 30° to 60° for example, at about 45°.

Guide channel structure 32 also is formed to extend onto frontal extension 40. Frontal extension 40 terminates in a free tip 42 that is flanked by a pair of enlarged wings 44 that are forwardly flared outwardly from one another to define an enlarged mouth 45 which facilitates the assembly of tether 80 on head assembly 20.

Head assembly 20 also includes a harness 24, noted above. Harness 24 is best seen in reference to FIGS. 1, 2 and 4 where it may be seen that harness structure 24 includes left and right rear straps 46 and left and right front straps 48. The upper ends of the left and right rear straps 46 are secured to helmet 22 in such manner that the location thereof can move reciprocally from front to back in sagittal plant "S". To this end, as may be seen in FIG. 3, left and right rear straps 46 may be formed as a single common strap that extends over a bar 48 that runs longitudinally in an opening 50 formed at the rear of helmet 22. Left and right front straps 48 have upper ends secured to helmet 22 on opposite lateral sides thereof and each have a lower end opposite a respective upper end. The lower end of left front strap is secured to the lower end of the left rear strap at a first location such as by connector 52 and, similarly, the lower end of the right front strap is connected to the lower end of the lower right rear strap by a similar connector 52 at a second location. A chinstrap 54 extends between the first and second locations chinstrap 54 is adjustable with an adjustable release clip 56 and carries a mandible chin support 58 that receives the chin of the wearer.

A brace piece in the form of saddle 60 is mounted between and supported by left and right rear straps 46. To this end, each of left and right rear straps 46 is provided with a slide clip 62. Saddle 60, which is preferably formed of a stiff yet bendable material, such as plastic, leather, rubber, etc. is then secured to each side clip 62. While various constructions of saddle 60 may be contemplated by this invention, it has been found that a serpentine plastic piece is highly suitable for comfort and engagement of the person's head, just below the posterior protuberance located at the back of the head. To this end, when helmet 22 is in the mounted state, slide clips 62 are adjusted so that saddle 60 rests just below the external protuberance at the atlanto occipital joint between the head and the $C_1$ vertebra of the spine. Connectors 52 are also appropriately positioned so that, when in the mounted state, clips 52 are located proximately to the temporo mandibular joints of the jaw.

With this construction, the rear straps 48 provide posterior strapping for harness 24 while the front straps 48 provide anterior strapping. These straps are preferably formed of a woven nylon of about ½ to ¾ of an inch wide. The anterior strapping is important in cooperation with the mandible/chin support to absorb some of the upper posterior pull when the exercise apparatus 18 is operated. The posterior strapping is important not only for securing the atlanto occipital saddle but also for creating a round conformed union between the rotational axis point of the atlanto occipital saddle and the parietal portion of helmet 22. This posterior strapping diverges from each end of saddle 60 and conforms around the occipital bone and the inferior portion of the parietal bone and is braced superior to the posterior protuberance. When used, the downward tension force of tether 80 in conjunction with the rigid nature of helmet 22 and the structure of harness 24 tend to tilt the helmet 22 causing an elevation of saddle 60 thereby avoiding compression of the atlanto occipital joint. Moreover, this elevation increases as the head is extended to an extension state and acts to elevate both the atlanto occipital joint and the atlanto axial joint between vertebrae $C_1$ and $C_2$. Moreover, this action helps to maintain the spaces of the neural arches of the inferior vertebrae. This action provides a significant improvement over prior art neck exercising apparatus.

With reference again to FIG. 2, it may be appreciated that head assembly 20 is interconnected by tether 80 to an anchor assembly 64. In this embodiment, anchor assembly 64 is in the form of an elongated bar 66 that is provided with stirrups 68 and 69 on opposite end portions 70 and 71, respectively, of bar 66. A triangular connector 72 is located medially of bar 66 and connects to tether 80 in any convenient manner. Foot stirrups 68 and 69 are secured to bar 66 by any convenient manner and, likewise, connector 72 is mounted in any conventional manner.

Tether 80 is best shown in FIG. 2 and, it should be appreciated, that at least a portion of the flexible tether is both elastic and resilient. In the embodiment shown in FIGS. 1–4, tether 80 is entirely elastic and resilient and is in the form of a length of rubber tubing. Tether 80 has a first end 84 releasably secured posteriorly of helmet 22 with a first end portion 82 extending over the cam structure of upper helmet surface 30 and the upper surface 41 of frontal extension 40 that is formed as a continuation of surface 30.

Tether 80 has a second end portion 86 which may be looped around connector 72 and fastened by an adjustable bracket 88 such that the effective length of tether 80 may be adjusted to accommodate for desired distances between head assembly 20 and anchor assembly 64. This can accommodate different heights of persons using the exercise apparatus 18 as well as use of the exercise apparatus 18 in a standing or sitting position. It should be appreciated that by providing releasable clamp 38 to secure first end 84, rubber tubes of varying spring constants may be selectively mounted onto helmet 22. This allows the user to change the resistance applied during exercise.

Figure 5:
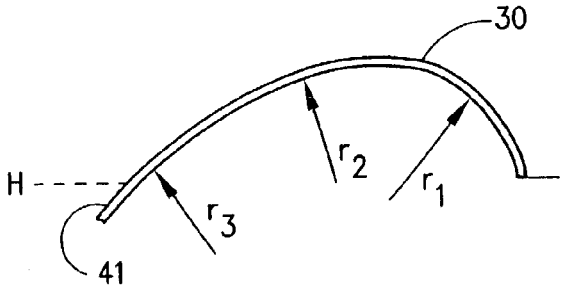
FIG. 5 is a diagrammatic view showing the curvature of the articulating cam surface used with the head assembly of FIGS. 1–4.
Figure 6:
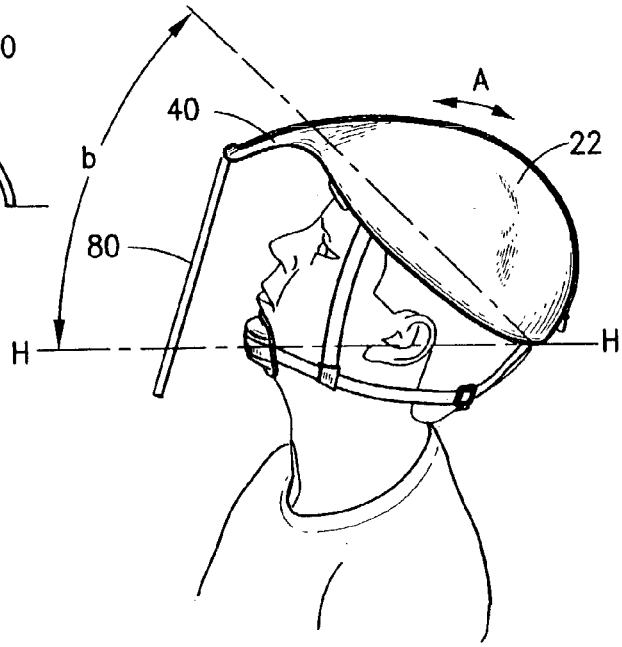
FIG. 6 is a perspective view, similar to FIG. 1, but showing the rotation of the person's head into an extension state.

In order to appreciate the operation of the device, as described more thoroughly below, references first made to FIG. 5 which shows the effective cam surface that corresponds to the upper surface 30 of helmet 22 and upper surface 41 of frontal extension 40. Here, it may be seen that the radius of curvature of this cam surface changes from a smaller radius of curvature $r_1$ at the posterior portion of helmet 22 to a larger radius of curvature $r_2$ at a mid portion of helmet 22 to a still larger radius of curvature $r_3$ at anterior location on helmet 22. This radius of curvature interacts with the increasing force caused by the stretching of tether 80 as the head assembly 20 is articulated from either a horizontal plane that is, the natural 0° position to an approximate 45° of extension, as is illustrated in FIG. 6. In this rotation, as is illustrated in FIG. 6 by arrow "A", the head is tilted in the sagittal plane from a horizontal axis "H" though an angle "b" that is preferably approximately 45° at which point frontal extension 40 is generally horizontal. The cam surface of helmet 22 is designed to replicate the torque curve of the joint action of the cervical spine and muscles. The size and shape of the helmet as the head is tilted from horizontal plane "H" the resistance is first increased as the line of pull travels down the frontal slope of the frontal extension and this force escalates until an orientation corresponding to an approximate 45° extension of the head and neck is achieved. The dynamic tension to the muscles, however, has a tendency to decrease due to the natural counter balancing of the weight of the head when the head and neck are in the 45-degree extension orientation. The helmet shape also creates an articulation as a result of the chinstrap 54 and chin cup 56 so that the spring force of tether 80 accordingly pulls up on saddle 60. The structure of this invention thereby permits the spinal column to change its shape and allows natural biomechanics and realignment of the cervical and related vertebrae during this resisted cervical extension without compression of the cervical spine.

Figure 7:
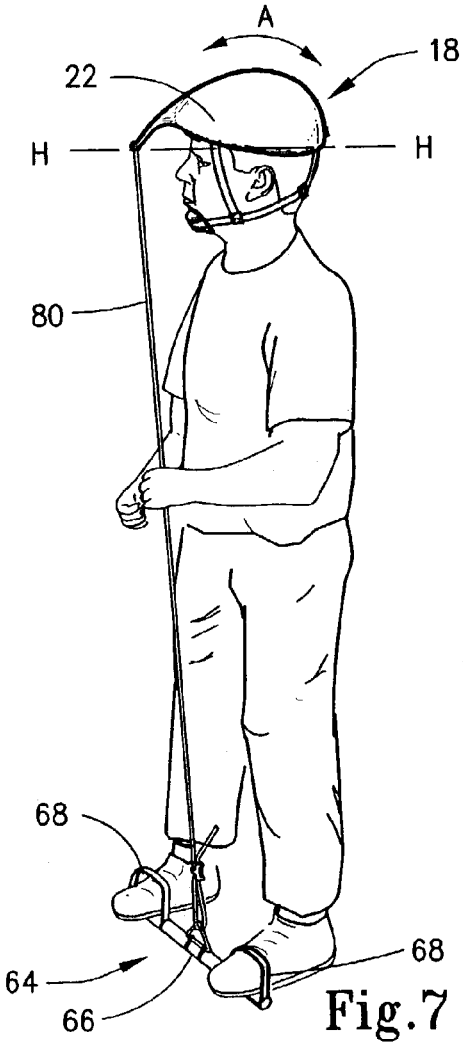
FIG. 7 is a perspective view showing use of the present invention in a standing position.
Figure 8:
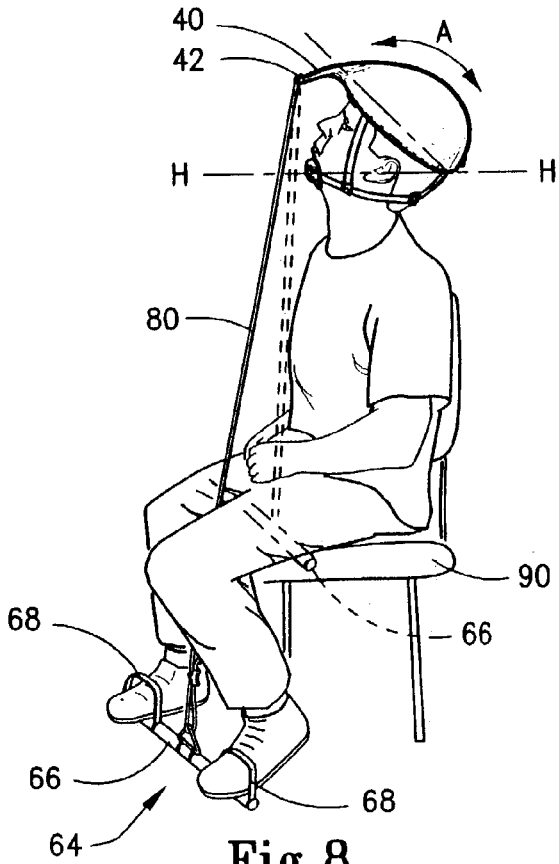
FIG. 8 is a perspective view showing use of the first exemplary embodiment of the present invention with a person shown in a seated position.

With reference to FIGS. 7 and 8, it may be seen that use of exercise apparatus 18 may take place in several different manners. In FIG. 7, exercise apparatus 18 is shown in use in a standing position. Here, the feet of the user 18 are engaged in stirrups 68 and 69 of anchor 64 with bar 66 located under the balls of the feet. The length of tether 80 is adjusted so that the helmet 22 may generally be positioned in the horizontal plane "H" with whatever force is desired due to the adjustment of the length of tether 80. Helmet 22 is then articulated in the direction of arrow "A" through the approximate 45-degree extension, noted above.

Alternatively, as is shown in FIG. 8, the person may use the apparatus in a seated orientation. Here, again, bar 66 of anchor assembly 64 is again positioned beneath the balls of the feet with the feet received in stirrups 68 and 69. The length of tether 80 is adjusted for the reduced distance between tip 42 of the frontal extension 40 and bar 66. Articulation then occurs in the direction of arrow "A". Also, as is shown in phantom in FIG. 8, bar 686 may be positioned between the seat of chair 90 and the thighs of the user with tether 80 being further shortened. Operation of the exercise apparatus is then the same as described above.

Figure 9:
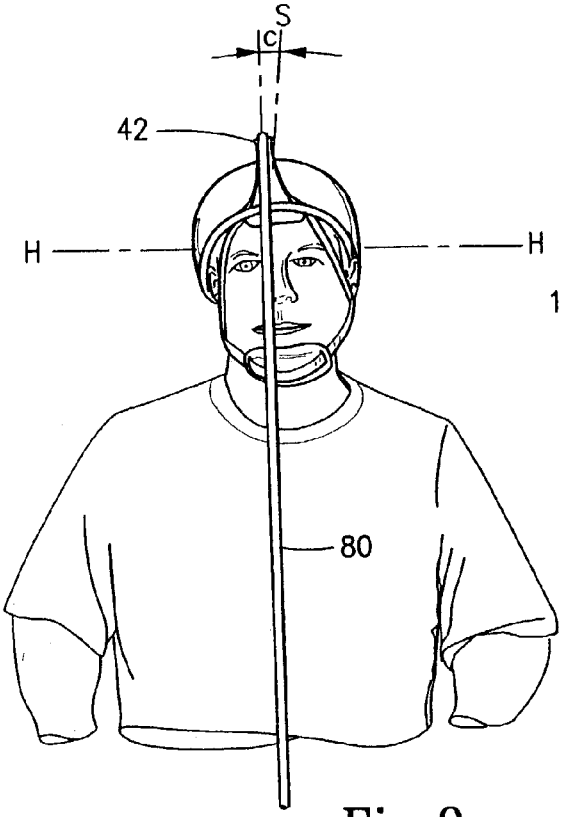
FIG. 9 is a front view in elevation illustrating the lateral displacement of the head assembly relative to the sagittal plane.

With reference now to FIG. 9, the apparatus of the present invention provides a further benefit of exercising the posterior cervical muscles so as to selectively strengthen weaker muscles. Here, it is illustrated that, as articulation reaches a 45-degree extension, the spring force applied by tether 80 acting on tip 42 creates an unstable condition. The weakness of the muscles, for example, on the left side of the neck, will result in the tendency for the head to deflect angularly with respect to the sagittal plane "S". Here, for example, it is shown that the head is deflected as small acute angle "c" with respect to plane "S". Accordingly, in order to move the head erect so that it is aligned with the sagittal plane, the user must employ the weaker posterior cervical muscles. Heretofore, exercise machines have typically exercised the occipitals as a pair so that the weaker muscle actually receives less exercise since it piggybacks on the strength of the stronger occipital muscle provides most of the force to counteract weight placed thereon. Since correction of many of the maladies noted in the background of this invention rely upon an equal balance in strength of the left and right cervical muscles, the present invention serves to exercise these muscles independently to a balanced strength condition because the deflection of the head tends to automatically isolate and exercise the weaker muscles until they are balanced with the stronger muscles. The reason is that, during articulation from the neutral position to the 45-degree extension, muscular stabilization and laterally balancing is required to keep the head aligned in the sagittal plane "S".

Figure 10:
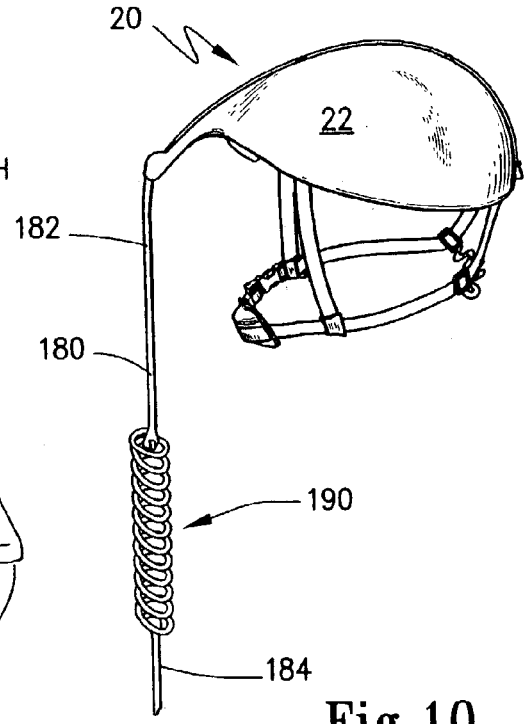
FIG. 10 is a perspective view showing a first alternative exemplary embodiment of the present invention.

It should be appreciated that other constructions of the exercise apparatus 18 are contemplated by the present invention. For example, as is illustrated in FIG. 10, the structure of tether 80 is modified. Here, tether 180 is shown to include a pair of flexible but inelastic portions 182 and 184 which are interconnected by a resilient spring 190. Inelastic portion 182 mounts onto head assembly 20 and extend over helmet 22 to be connected in a manner similar to tether 80. Here, however, spring 190 provides the increasing tension force that is applied to helmet 22 during articulation as a result of its spring constant. Rather than providing an elastic cord, spring 190 simply expands and contracts to provide the force of resistance. Different springs could be interchanged to apply different forces during exercise.

Figure 11:
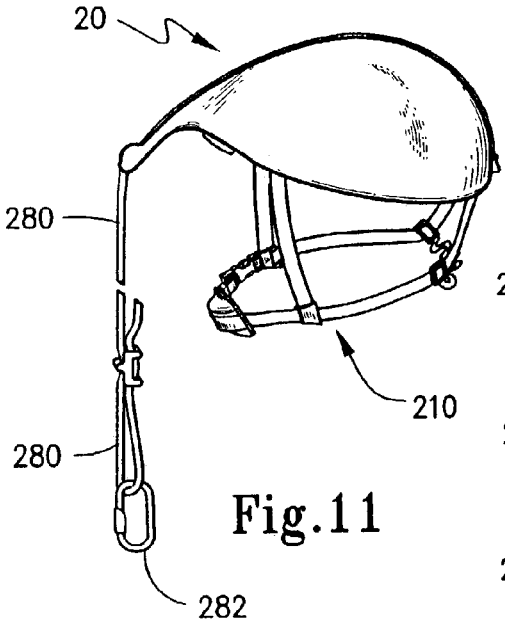
FIG. 11 is a perspective view showing a second alternative exemplary embodiment of the present invention.
Figure 12:
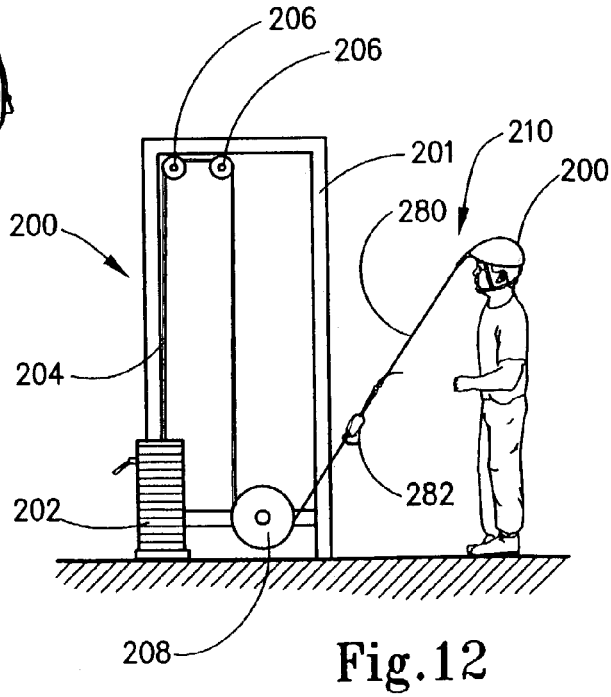
FIG. 12 is a side view in elevation showing use of the embodiment of FIG. 11 with a variable resistance machines.

It is also possible to make the tether completely inelastic provided, however, that some other means for providing a variable resistance is coupled to the tether. In FIG. 11, it may be seen that head assembly 20 is connected to tether 280 that is formed as flexible but inelastic cord that is provided, at is lower end, with a releasable clip 282. This helmet and tether assembly 210 may be employed with existing exercise equipment such as illustrated in FIG. 12. Here, the helmet and tether assembly 210 is shown connected to an exercise apparatus 200 that, for example, includes a weight stack 202 that is connected to a cable 204 and pulleys 206 to extend around a cam 208 that is rotatably journaled to frame 201. As the person articulates head assembly 200, cam 208 is rotated which provides an increasing variable resistance as selected weights are pulled upwardly from weight stack 202, as is known in the art.

From the foregoing, it should be appreciated that the present invention not only contemplates the exercise apparatus as here and before described but also is directed to a method of exercise in the neck.

The present invention also contemplates a method of exercising the head and neck of a person. This method may include any of the steps that are accomplished by the structure described with respect to the apparatus described in this disclosure as well as the actions accomplished by such structure. Broadly, the method of the present invention includes the step of engaging the atlanto occipital joint region of the neck with a saddle piece. A source of variable force is provided, and the saddle piece is coupled to this source of variable force. The method then includes the step of rotating the head and neck into an orientation corresponding to extension thereof in such manner that are varying upward force is applied to the saddle and thereby to the allanto occipital joint.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. Apparatus adapted to mount onto the neck and head of a person whereby the person may exercise the neck, comprising:

(A) a head assembly including (1) a cap portion constructed as a rigid helmet having an interior cavity adapted to receive the head of the person, said helmet having an upper helmet cam surface extending from a posterior portion of said helmet to an anterior portion of said helmet, said helmet further including a frontal extension projecting forwardly of the person's forehead when in a mounted state, said frontal extension having an upper surface formed as a continuation of the helmet cam surface, said helmet and said frontal extension including a guide channel extending from a posterior portion of said helmet along said cam surface and continuing along the upper surface of said frontal extension, (2) a harness operative to secure said cap portion on the head to define a mounted state and (3) a saddle piece extending across a back portion of the neck when in the mounted state;

(B) an anchor assembly; and (C) a flexible tether adapted to interconnect said cap portion and said anchor assembly in an assembled state, said flexible tether having a first end secured to a posterior portion of said helmet when in the assembled state with a first end portion extending across the cam surface and across the upper surface of said frontal extension in said guide channel.

2. Apparatus according to claim 1 wherein said first end portion of said tether is slidably received in the guide channel structure.

3. Apparatus adapted to mount onto the neck and head of a person whereby the person may exercise the neck, comprising:

(A) a head assembly including (1) a cap portion adapted to be worn on the head, (2) a harness operative to secure said cap portion on the head to define a mounted state and (3) a saddle piece extending across a back portion of the neck when in the mounted state;

(B) an anchor assembly including a pair of foot stirrups; and (C) a flexible tether adapted to interconnect said cap portion and said anchor assembly in an assembled state, said flexible tether including an elastic and resilient portion.

4. Apparatus adapted to mount onto the neck and head of a person whereby the person may exercise the neck, comprising:

(A) a head assembly including (1) a rigid helmet adapted to be worn on the head and having an interior cavity adapted to receive the head of the person;

(2) a harness operative to secure said helmet on the head to define a mounted state, said harness including (a) left and right rear straps each having an upper end secured at laterally spaced-apart locations to a posterior portion of said helmet and lower ends opposite a respective upper end;

(3) a saddle piece mounted between and supported by said left and right rear straps and extending across a back portion of the neck when in the mounted state;

(B) an anchor assembly; and (C) a flexible tether adapted to interconnect said cap portion and said anchor assembly in an assembled state, said flexible tether including an elastic and resilient portion; and (D) wherein said anchor assembly includes an elongated rigid bar and a pair of foot stirrups.

* * * * *